US009607752B2

(12) United States Patent
Kim et al.

(10) Patent No.: US 9,607,752 B2
(45) Date of Patent: Mar. 28, 2017

(54) WIRE-WOUND INDUCTOR AND METHOD FOR MANUFACTURING THE SAME

(71) Applicant: SAMSUNG ELECTRO-MECHANICS CO., LTD., Suwon-Si, Gyeonggi-Do (KR)

(72) Inventors: Yu Na Kim, Suwon-Si (KR); Jong Ho Lee, Suwon-Si (KR); Sang Ho Shin, Suwon-Si (KR); Moon Soo Park, Suwon-Si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 14/970,418

(22) Filed: Dec. 15, 2015

(65) Prior Publication Data

US 2016/0217914 A1 Jul. 28, 2016

(30) Foreign Application Priority Data

Jan. 27, 2015 (KR) ..... 10-2015-0012820

(51) Int. Cl.

| | |
|---|---|
| ***H01F 5/00*** | (2006.01) |
| ***H01F 27/28*** | (2006.01) |
| ***H01F 27/29*** | (2006.01) |
| ***B22F 9/02*** | (2006.01) |
| ***B22F 1/00*** | (2006.01) |
| ***H01F 17/04*** | (2006.01) |

(52) U.S. Cl.

CPC ..... *H01F 27/2828* (2013.01); *B22F 1/0059* (2013.01); *B22F 9/02* (2013.01); *H01F 17/04* (2013.01); *H01F 27/292* (2013.01); *B22F 2001/0066* (2013.01); *H01F 2017/048* (2013.01)

(58) Field of Classification Search

CPC ..... H01F 27/2828

See application file for complete search history.

(56) References Cited

U.S. PATENT DOCUMENTS

2006/0049907 A1 3/2006 Liu
2014/0062638 A1* 3/2014 Sasamori ..... H01F 27/2847 336/175

FOREIGN PATENT DOCUMENTS

KR 10-2012-0031349 A 4/2012
KR 10-2014-0038781 A 3/2014

OTHER PUBLICATIONS

English translation of JP2003347132.*

* cited by examiner

*Primary Examiner* — Mangtin Lian
*Assistant Examiner* — Ronald Hinson
(74) *Attorney, Agent, or Firm* — McDermott Will & Emery LLP

(57) ABSTRACT

A wire-wound inductor includes: a magnetic core; a first coil unit embedded in the magnetic core and formed by winding a conductive wire; a pair of second coil units bent from both ends of the first coil unit and including lead portions exposed to opposing surfaces of the magnetic core; and a pair of external terminals disposed on the opposing surfaces of the magnetic core and electrically connected to the lead portions of the pair of second coil units, respectively.

9 Claims, 5 Drawing Sheets

| No. | LENGTH (μm) | | DIMENSION RATIO | Rdc (mΩ) | |
|---|---|---|---|---|---|
| | L1 | L2 | | Min | Max |
| 1 | 2500 | 50 | 0.02 | 43 | 81 |
| 2 | 2500 | 70 | 0.028 | 42 | 75 |
| 3 | 2500 | 90 | 0.036 | 40 | 71 |
| 4 | 2500 | 110 | 0.044 | 51 | 69 |
| 5 | 2500 | 130 | 0.052 | 49 | 57 |
| 6 | 2500 | 150 | 0.06 | 43 | 69 |
| 7 | 2500 | 170 | 0.068 | 47 | 65 |
| 8 | 2500 | 190 | 0.076 | 42 | 51 |
| 9 | 2500 | 210 | 0.084 | 47 | 59 |
| 10 | 2500 | 230 | 0.092 | 41 | 57 |
| 11 | 2500 | 250 | 0.1 | 42 | 44 |
| 12 | 2500 | 270 | 0.108 | 43 | 46 |
| 13 | 2500 | 290 | 0.116 | 42 | 44 |
| 14 | 2500 | 310 | 0.124 | 40 | 47 |
| 15 | 2500 | 330 | 0.132 | 42 | 48 |
| 16 | 2500 | 350 | 0.14 | 41 | 47 |
| 17 | 2500 | 370 | 0.148 | 44 | 55 |
| 18 | 2500 | 390 | 0.156 | 44 | 57 |
| 19 | 2500 | 410 | 0.164 | 43 | 61 |
| 20 | 2500 | 430 | 0.172 | 41 | 62 |
| 21 | 2500 | 450 | 0.18 | 41 | 68 |
| 22 | 2500 | 470 | 0.188 | 43 | 77 |
| 23 | 2500 | 490 | 0.196 | 40 | 69 |
| 24 | 2500 | 510 | 0.204 | 41 | 71 |
| 25 | 2500 | 530 | 0.212 | 49 | 75 |
| 26 | 2500 | 550 | 0.22 | 40 | 78 |
| 27 | 2500 | 570 | 0.228 | 45 | 69 |
| 28 | 2500 | 590 | 0.236 | 41 | 79 |

| No. | LENGTH (㎛) | | DIMENSION RATIO | Rdc (mΩ) | |
|---|---|---|---|---|---|
| | L1 | L2 | | Min | Max |
| 1 | 2500 | 50 | 0.02 | 43 | 81 |
| 2 | 2500 | 70 | 0.028 | 42 | 75 |
| 3 | 2500 | 90 | 0.036 | 40 | 71 |
| 4 | 2500 | 110 | 0.044 | 51 | 69 |
| 5 | 2500 | 130 | 0.052 | 49 | 57 |
| 6 | 2500 | 150 | 0.06 | 43 | 69 |
| 7 | 2500 | 170 | 0.068 | 47 | 65 |
| 8 | 2500 | 190 | 0.076 | 42 | 51 |
| 9 | 2500 | 210 | 0.084 | 47 | 59 |
| 10 | 2500 | 230 | 0.092 | 41 | 57 |
| 11 | 2500 | 250 | 0.1 | 42 | 44 |
| 12 | 2500 | 270 | 0.108 | 43 | 46 |
| 13 | 2500 | 290 | 0.116 | 42 | 44 |
| 14 | 2500 | 310 | 0.124 | 40 | 47 |
| 15 | 2500 | 330 | 0.132 | 42 | 48 |
| 16 | 2500 | 350 | 0.14 | 41 | 47 |
| 17 | 2500 | 370 | 0.148 | 44 | 55 |
| 18 | 2500 | 390 | 0.156 | 44 | 57 |
| 19 | 2500 | 410 | 0.164 | 43 | 61 |
| 20 | 2500 | 430 | 0.172 | 41 | 62 |
| 21 | 2500 | 450 | 0.18 | 41 | 68 |
| 22 | 2500 | 470 | 0.188 | 43 | 77 |
| 23 | 2500 | 490 | 0.196 | 40 | 69 |
| 24 | 2500 | 510 | 0.204 | 41 | 71 |
| 25 | 2500 | 530 | 0.212 | 49 | 75 |
| 26 | 2500 | 550 | 0.22 | 40 | 78 |
| 27 | 2500 | 570 | 0.228 | 45 | 69 |
| 28 | 2500 | 590 | 0.236 | 41 | 79 |

FIG. 5

| No. | LENGTH (μm) | | DIMENSION RATIO | Rdc (mΩ) | |
|---|---|---|---|---|---|
| | L1 | L2 | | Min | Max |
| 1 | 2000 | 70 | 0.035 | 271 | 347 |
| 2 | 2000 | 90 | 0.045 | 290 | 351 |
| 3 | 2000 | 110 | 0.055 | 281 | 331 |
| 4 | 2000 | 130 | 0.065 | 275 | 329 |
| 5 | 2000 | 150 | 0.075 | 270 | 315 |
| 6 | 2000 | 170 | 0.085 | 265 | 309 |
| 7 | 2000 | 190 | 0.095 | 260 | 311 |
| 8 | 2000 | 210 | 0.105 | 267 | 287 |
| 9 | 2000 | 220 | 0.11 | 255 | 280 |
| 10 | 2000 | 230 | 0.115 | 269 | 288 |
| 11 | 2000 | 250 | 0.125 | 271 | 279 |
| 12 | 2000 | 270 | 0.135 | 280 | 281 |
| 13 | 2000 | 290 | 0.145 | 270 | 301 |
| 14 | 2000 | 310 | 0.155 | 271 | 315 |
| 15 | 2000 | 330 | 0.165 | 269 | 311 |
| 16 | 2000 | 350 | 0.175 | 280 | 324 |
| 17 | 2000 | 370 | 0.185 | 284 | 341 |

FIG. 6

WIRE-WOUND INDUCTOR AND METHOD FOR MANUFACTURING THE SAME

CROSS-REFERENCE TO RELATED APPLICATION

This application claims the benefit of Korean Patent Application No. 10-2015-0012820 filed on Jan. 27, 2015, with the Korean Intellectual Property Office, the disclosure of which is incorporated herein by reference.

BACKGROUND

The present disclosure relates to a wire-wound inductor and a method for manufacturing the same.

Inductors are passive components using electromagnetic energy generated by applying current to conductive wires wound around a core. An inductor may be combined with a capacitor to form a resonant circuit, may be used in a filter circuit to filter signals of a specific type, or may be used for impedance matching.

Recently, in line with the continuing development of electronic and communication technologies, environmental issues and communications failures have arisen. Thus, the development of devices for removing electromagnetic interference generated between devices has been demanded, and devices commonly have multifunctionality, high degrees of integration, and high levels of efficiency implemented therein, while demand for such electromagnetic wave interference removing devices has rapidly increased.

As electronic and communications devices are becoming compact and highly efficient, heating thereof needs to be suppressed by reducing the size and resistance of components or devices in use. Thus, improvement toward reducing the size and resistance of inductors used in electronic and communications devices is required.

SUMMARY

An exemplary embodiment in the present disclosure provides a wire-wound inductor including a magnetic core, a first coil unit embedded in the magnetic core, a pair of second coil units bent from both ends of the first coil unit and including lead portions exposed to opposing surfaces of the magnetic core; and a pair of external terminals electrically connected to the lead portions of the pair of second coil units.

BRIEF DESCRIPTION OF DRAWINGS

The above and other aspects, features and advantages of the present disclosure will be more clearly understood from the following detailed description taken in conjunction with the accompanying drawings, in which:

FIGS. 5 and 6 are tables illustrating contact resistance values of a coil element according to values L1 and L2 of FIG. 4.

DETAILED DESCRIPTION

Figure 1:
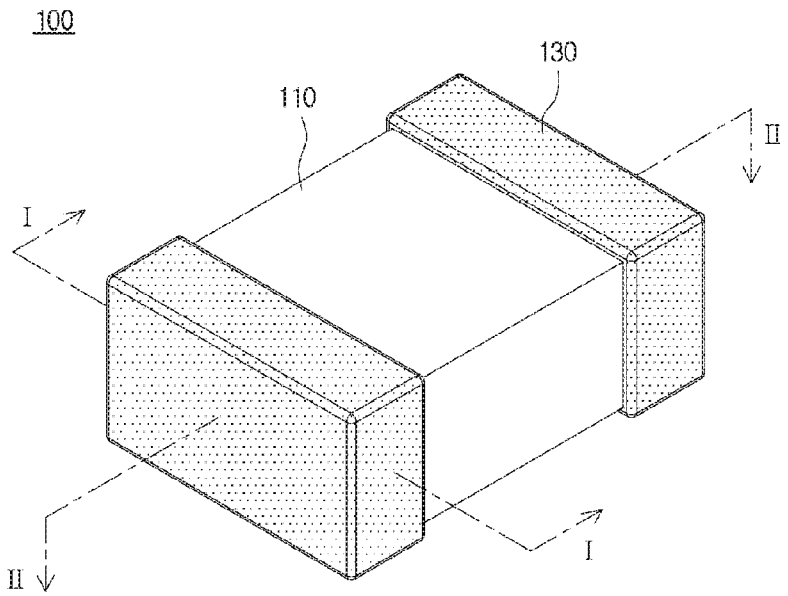
FIG. 1 is a perspective view of a wire-wound inductor according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Figure 2:
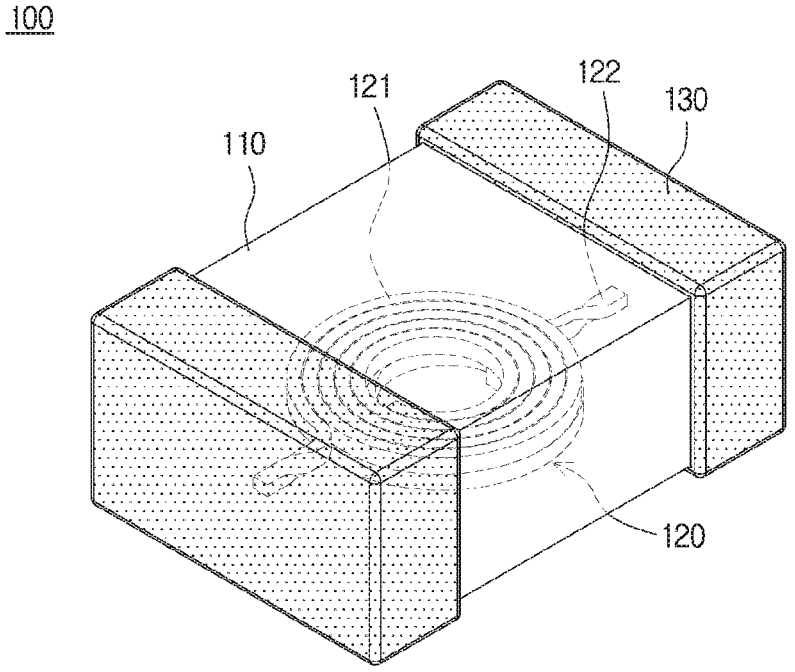
FIG. 2 is a view of an internal structure of the wire-wound inductor according to an exemplary embodiment in the present disclosure.
Figure 3:
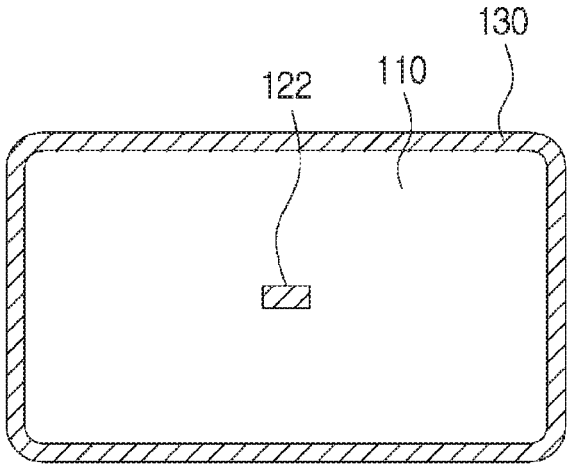
FIG. 3 is a cross-sectional view of the wire-wound inductor taken along line I-I of FIG. 1.

FIG. 1 is a perspective view of a wire-wound inductor according to an exemplary embodiment in the present disclosure, and FIG. 2 is a view of an internal structure of the wire-wound inductor according to an exemplary embodiment in the present disclosure. FIG. 3 is a cross-sectional view of the wire-wound inductor taken along line I-I of FIG. 1.

Referring to FIGS. 1 through 3, a wire-wound inductor 100 according to an exemplary embodiment in the present disclosure may include a magnetic core 110, a coil element 120, and external terminals 130. The coil element 120 may include a first coil unit 121 and a second coil unit 122.

The magnetic core 110 forms a space in which a magnetic path is formed. When current is applied to the coil element 120 through the external terminals 130, magnetic flux is induced in the coil element 120, and the magnetic flux induced in the coil element 120 may pass along the magnetic path formed by the magnetic core 110.

The magnetic core 110 forms the exterior appearance of the wire-wound inductor 100 according to the present exemplary embodiment. As illustrated in FIG. 1, the magnetic core 110 may have a rectangular shape and may also have various other shapes, such as a cylindrical shape, a spherical shape, or a polyprismatic shape.

The magnetic core 110 may be formed of a mixture of a magnetic metal powder and a resin. The magnetic metal powder may include particles of an iron-chromium-silicon alloy or an iron-aluminum-silicon alloy having high electrical resistance, reducing loss of magnetic force, and facilitating changes in impedance design by adjusting compositions.

The resin serves as an insulating material interposed between the magnetic metal powder particles, and further serves to secure adhesive strength between the magnetic core 110 and the coil element 120. As the resin, an epoxy resin, a phenol resin, or polyester may be used.

The coil element 120 includes the first coil unit 121 and the second coil unit 122, and is embedded in the magnetic core 110 as illustrated in FIG. 2. The first coil unit 121 and the second coil unit 122 are integrally formed to constitute the coil element 120.

The first coil unit is formed by a wound conductive wire. FIG. 2 illustrates a cylindrical first coil unit 121 having a hollow portion therein, but an overall shape of the first coil unit 121 may be modified according to shapes in which a conductive wire is wound.

A target inductance value may be realized in the first coil unit 121 by adjusting the number of windings of a conductive wire. As a material of the conductive wire forming the first coil unit 121, a metal such as silver, lead, platinum, nickel, or copper having excellent conductivity may be used, and an alloy obtained by mixing two or more thereof may also be used.

The second coil unit 122 is provided as a pair, and the pair of second coil units 122 may be bent from both ends of the first coil unit 121. That is, the second coil units 122 are bent from both ends of the first coil unit 121 in an outward direction of the first coil unit 121.

Also, the lead portions of the pair of second coil units 122 are exposed to the outer surfaces of the magnetic core 110. That is, the second coil units 122 extend from both ends of the first coil unit 121 to the outer surfaces of the magnetic core 110.

Since the second coil units 122 are integrally formed with the first coil unit 121, the second coil units 122 may be formed of the same material as that of the conductive wire forming the first coil unit 121, and as illustrated in FIG. 3, the first coil unit 121 and the second coil units 122 may be formed of a conductive wire having a rectangular cross-sectional shape.

The external terminals 130 are provided as a pair, and the pair of external terminals 130 are formed on the opposing surfaces of the magnetic core 110 and electrically connected to the lead portions of the second coil units 122, respectively.

The external terminals 130 are formed on the opposing surfaces of the magnetic core 110, to which the lead portions of the pair of second coil units 122 are exposed, among a plurality of surfaces of the magnetic core 110, such that the external terminals 130 are electrically connected to the second coil units 122. Accordingly, the external terminals 130 and the coil element 120 may be electrically connected to each other, and current may be applied to the coil element 120 embedded in the magnetic core 110 through the pair of external terminals 130.

The external terminals 130 may be extended to cover portions of upper and lower surfaces and side surfaces of the magnetic core 110.

The external terminals 130 may be in contact with the second coil units 122 so as to be electrically connected thereto. A contact resistance value of the coil element 120 may vary according to contact areas of the external terminals 130 and the second coil units 122, and if the contact resistance value varies according to products, reliability of product performance may not be secured.

In the wire-wound inductor 100 according to the present exemplary embodiment, since the lead portions of the second coil units 122 are exposed to the outer surfaces of the magnetic core 110, the lead portions of the second coil units 122 may be in contact with the external terminals 130.

The contact areas of the second coil units 122 and the external terminals 130 may be equal to the cross-sectional areas of the conductive wire forming the second coil units 122, and thus, the wire-wound inductor 100 may have a uniform contact area between the second coil units 122 and the external terminals 130.

The second coil units 122 may extend from the ends of the first coil unit 121 to the outer surface of the magnetic core 110 by a shortest distance. In detail, the second coil units 122 extend radially from the first coil unit 121 in a direction perpendicular to the outer surface of the magnetic core 110 by a shortest distance.

As the length of the second coil units 122 changes, overall resistance characteristics of the coil element 120 may change. Thus, it is required to uniformly maintain the length of the second coil units 122. When the second coil units 122 extend from the ends of the first coil unit 121, the second coil units 122 lead out from the first coil unit 121 to the outer surfaces of the magnetic core 110 by a shortest distance, thereby limiting changes in resistance values that may be generated in each product.

Also, the second coil units 122 may be twisted while being extended from the ends of the first coil unit 121. That is, the second coil units 122 are bent from the ends of the first coil unit 121, led out in an outward direction of the first coil unit 121, and twisted and extended to the outer surface of the magnetic core 110.

In this manner, since the second coil units 122 are twisted while being extended from the ends of the first coil unit 121, rigidity of the second coil units 122 may be enhanced. In a case in which the coil element 120 is disposed within the magnetic core 110, the first coil unit 121 formed by winding a conductive wire several times rarely changes in shape, while the second coil units 122 formed as a single layer of a conductive wire may be changed in shape due to external force applied to the second coil units 122 within the magnetic core 110. In particular, an angle at which the second coil units 122 are led out from the first coil unit 121 or the position of the lead portions of the second coil units 122 in contact with the external terminals 130 may be changed.

When the angle of the second coil units 122 is changed, a length from one end of the conductive wire forming the first coil unit 121 to the lead portions of the second coil units 122 in contact with the external terminals 130 is changed, and an area of the lead portions of the second coil units 122 in contact with the external terminals 130 may also be changed.

When the length of the second coil units 122 or the contact area of the second coil units 122 in contact with the external terminals 130 is changed, an overall contact resistance value of the coil element 120 may be changed, and thus, it is very important to limit changes in shape or position of the second coil units 122 within the magnetic core 110.

Since the second coil units 122 of the wire-wound inductor 100 according to the present exemplary embodiment are twisted while being extended from the ends of the first coil unit 121, rigidity of the second coil units 122 may be secured and resistance to external force transferred to the second coil units 122 within the magnetic core 110 may increase.

A twist angle of the second coil units 122 may be changed according to required degree of rigidity. That is, a design value of the twist angle may be changed in consideration of desired twist strength of a conductive wire forming the second coil units 122 and a magnitude of external force applied to the second coil units 122 within the magnetic core 110.

Figure 4:
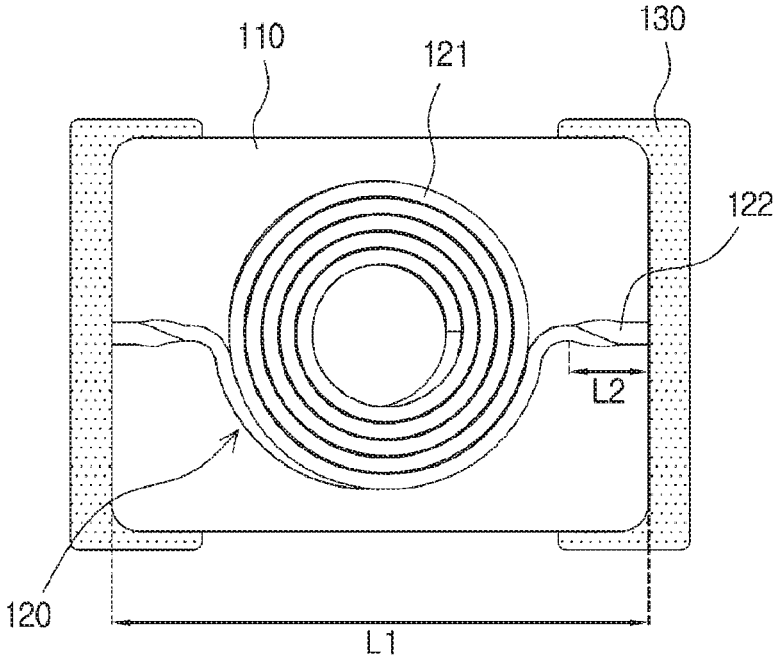
FIG. 4 is a cross-sectional view of the wire-wound inductor taken along line II-II of FIG. 1.

FIG. 4 is a cross-sectional view of the wire-wound inductor taken along line II-II of FIG. 1, and FIGS. 5 and 6 are tables illustrating contact resistance values of a coil element according to values L1 and L2 of FIG. 4.

Referring to FIGS. 4 through 6, in the wire-wound inductor 100 according to the present exemplary embodiment, a ratio of a length L2 of the second coil unit 122 to a length L1 of the magnetic core 110 may range from 0.1 to 0.14.

A contact resistance value Rdc of the coil element 120 embedded within the magnetic core 110 may be changed according to the length L2 of the second coil units 122 and the distance L1 between the opposing surfaces of the magnetic core 110 in contact with the lead portions of the pair of second coil units 122.

Thus, uniform contact resistance (Rdc) may be maintained by adjusting the ratio of the length L2 of the second coil units 122 and the length L1 of the magnetic core 110, which affects the contact resistance value (Rdc) of the coil element 120.

FIG. 5 illustrates results obtained by measuring contact resistance values (Rdc) of the coil element 120 while increasing the length L2 of the second coil units 122 by 20 μm each time from 50 μm to 590 μm, when the length L1 between the opposing surfaces of the magnetic core 110 is 2500 μm.

Referring to FIG. 5, it can be seen that the contact resistance values (Rdc) are relatively uniform when the ratio of the length L2 of each second coil unit 122 to the length L1 of the magnetic core 110 ranges from 0.1 to 0.14. In particular, it can be seen that a maximum value of the contact resistance (Rdc) was rapidly changed when the ratio of the length L2 to the length L1 is less than 0.1 or exceeds 0.14.

FIG. 6 illustrates results obtained by measuring contact resistance values (Rdc) of the coil element 120 while the length L2 of the second coil units 122 by 20 μm was gradually increased from 70 μm to 370 μm, when the length L1 between the opposing surfaces of the magnetic core 110 is 2000 μm.

Referring to FIG. 6, it can be seen that, the contact resistance (Rdc) of the coil element 120 is uniformly maintained when the ratio of the length L2 of each second coil unit to the length L1 of the magnetic core is maintained to be within the range from 0.1 to 0.14, even though the length L1 between the opposing surfaces of the magnetic core 110 changes.

Figure 7:
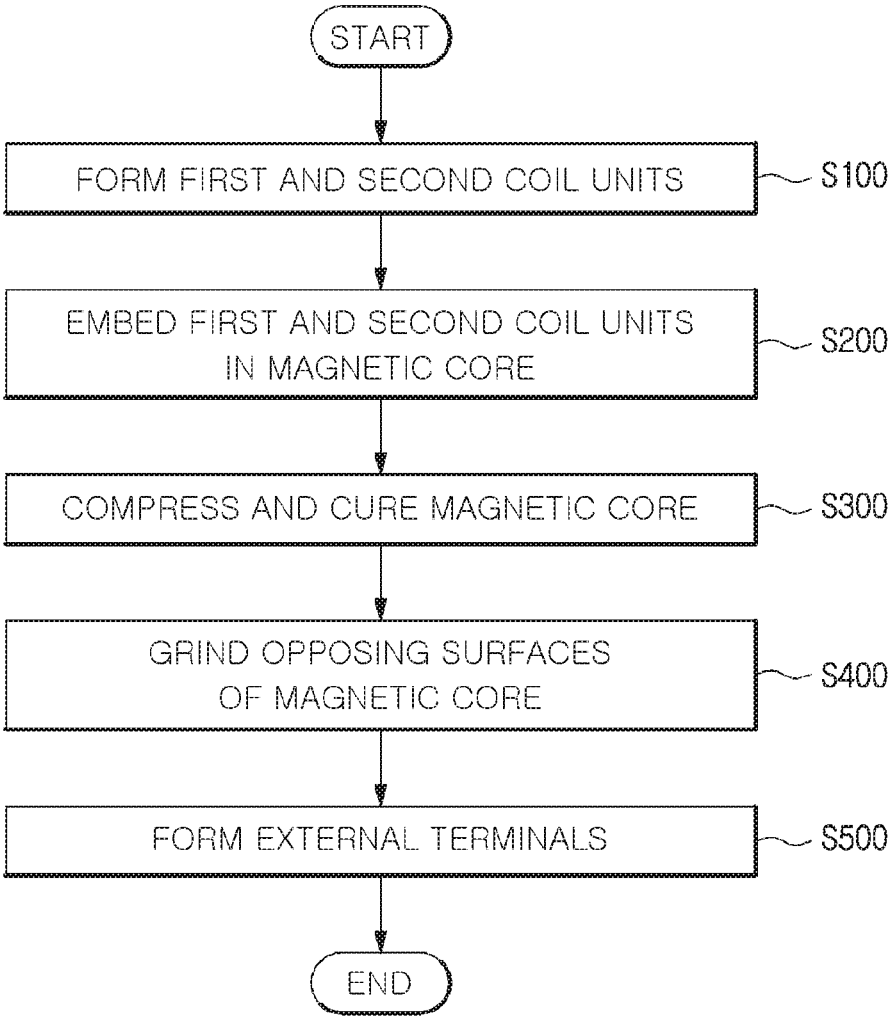
FIG. 7 is a flowchart illustrating a method for manufacturing a wire-wound inductor according to another exemplary embodiment in the present disclosure.

FIG. 7 is a flow chart illustrating a method for manufacturing a wire-wound inductor according to another exemplary embodiment in the present disclosure.

Referring to FIG. 7, a method for manufacturing a wire-wound inductor according to the present exemplary embodiment includes an operation (S100) of forming a first coil unit and a pair of second coil units, an operation (S200) of embedding the first coil unit and the second coil units in a magnetic core in a slurry state, an operation (S300) of compressing and curing the magnetic core, an operation (S400) of grinding opposing surfaces of the magnetic core, and an operation (S500) of forming a pair of external terminals.

In operation (S100) of forming the first coil unit and the second coil units, the first coil unit is formed by winding a conductive wire, and the pair of second coil units are bent from both ends of the first coil unit.

In detail, the first coil unit is formed by winding a conductive wire one or more times, and here, an overall shape of the first coil unit may be varied according to a shape in which the conductive wire is wound. The second coil units may be formed by bending and leading out both ends of the conductive wire forming the first coil unit in direction perpendicular to the direction in which the conductive wire is wound, namely, in an outward direction of the first coil unit.

Here, the first coil unit may be formed by winding the conductive wire while thermally bonding the conductive wire to maintain a wound shape of the conductive wire. The second coil units may also be formed by bending and leading out the conductive wire, while thermally bonding the conductive wire to maintain a shape of the second coil unit, that is, a lead-out angle thereof, or the like, with respect to the first coil unit.

In operation (S200) of embedding the first coil unit and the second coil units in the magnetic core, the first coil unit and the second coil unit are embedded in the magnetic core in a slurry state.

The first coil unit and the second coil units embedded in the magnetic core in the slurry state may move within the magnetic core in the slurry state, or external force may be applied to the first coil unit and the second coil unit due to an influence of viscosity of the slurry, or the like, resulting in deformation, rather than a shape thereof being maintained.

In particular, unlike the first coil unit formed by winding a conductive wire several times, the second coil units are formed as a single layer of conductive wire, and thus the second coil units may be significantly changed in terms of shape and position. When the shape and position of the second coil units are changed, a length of the second coil units or the area of the second coil units in contact with external terminals may be changed to change overall contact resistance of the coil element.

Thus, in operation (S100) of forming the first coil unit and the second coil units, the second coil units may be twisted while being extended from the ends of the first coil unit. In this manner, since the second coil units are twisted, rigidity thereof may be enhanced.

In operation (S300) of compressing and curing the magnetic core, the magnetic core in the slurry state is compressed and cured to determine the disposition of the coil element disposed within the magnetic core.

Operation (S300) of compressing and curing the magnetic core may include compressing the magnetic core within a room-temperature mold and compressing and curing the magnetic core within a thermosetting mold.

That is, the compressing may include provisionally compressing the magnetic core within the room-temperature mold and compressing the magnetic core within a thermosetting mold by applying heat to the magnetic core. Here, curing the magnetic core in the slurry state may be simultaneously performed within the thermosetting mold while the compressing is performed.

In operation (S400) of grinding opposing surfaces of the magnetic core, the opposing surfaces of the magnetic core are ground, such that lead portions of the pair of second coil units are exposed externally from the magnetic core.

An insulating layer may be formed on the conductive wire forming the first coil unit and the second coil units to cover the conductive wire. Here, the insulating layer is formed to insulate adjacent portions of the conductive wire. After the opposing surfaces of the magnetic core are ground, portions of the insulating layer covering the lead portions of the second coil units may be removed to allow the lead portions of the second coil units to be electrically connected to external terminals.

In operation (S500) of forming a pair of external terminals, the pair of external terminals are formed on the opposing surfaces of the magnetic core such that the pair of external terminals are electrically connected to the lead portions of the second coil units.

In operation (S500) of forming the pair of external terminals, a method of immersing side surfaces of the magnetic core in a molten metal to form metal films on the side surfaces of the magnetic core and plating the metal films with nickel and tin to form the external terminals may be used.

The method for manufacturing a wire-wound inductor according to the present exemplary embodiment may further include preparing the magnetic core in the slurry state by mixing a magnetic metal powder and a resin before or after operation (S100) of forming the first coil unit and the second coil units.

While exemplary embodiments have been shown and described above, it will be apparent to those skilled in the art that modifications and variations could be made without departing from the scope of the present invention as defined by the appended claims.

What is claimed is:

1. A wire-wound inductor comprising: a magnetic core; a first coil unit embedded in the magnetic core and formed by a wound conductive wire; a pair of second coil units bending from opposite ends of the first coil unit and including lead portions exposed to opposing surfaces of the magnetic core; and a pair of external terminals disposed on the opposing surfaces of the magnetic core and electrically connected to the lead portions of the pair of second coil units, respectively, wherein the pair of second coil units which extend from the opposite ends of the first coil unit are twisted, and a shape of a cross-section of each second coil unit corresponds to a shape of a cross-section of the first coil unit and wherein a ratio of a length of each second coil unit to a length of the magnetic core ranges from 0.1 to 0.14.

2. The wire-wound inductor of claim 1, wherein the pair of second coil units extend from the opposite ends of the first coil unit to the opposing surfaces of the magnetic core.

3. A wire-wound inductor, comprising:

a magnetic core;

a first coil unit embedded in the magnetic core and formed by a wound conductive wire;

a pair of second coil units bending from opposite ends of the first coil unit and including lead portions exposed to opposing surfaces of the magnetic core; and a pair of external terminals disposed on the opposing surfaces of the magnetic core and electrically connected to the lead portions of the pair of second coil units, respectively, wherein a ratio of a length of each second coil unit to a length of the magnetic core ranges from 0.1 to 0.14.

4. The wire-wound inductor of claim 1, wherein the first coil unit and the pair of second coil units are formed of a conductive wire having a rectangular cross-sectional shape.

5. The wire-wound inductor of claim 3, wherein the pair of second coil units which extend from the opposite ends of the first coil unit are twisted.

6. The wire-wound inductor of claim 3, wherein the pair of second coil units extend from the opposite ends of the first coil unit to the opposing surfaces of the magnetic core.

7. The wire-wound inductor of claim 3, wherein the first coil unit and the pair of second coil units are formed of a conductive wire having a rectangular cross-sectional shape.

8. The wire-wound inductor of claim 3, wherein the pair of second coil units extend radially from the first coil unit in a direction perpendicular to the opposing surfaces of the magnetic core.

9. The wire-wound inductor of claim 1, wherein the pair of second coil units extend radially from the first coil unit in a direction perpendicular to the opposing surfaces of the magnetic core.

* * * * *